US010132074B2

(12) United States Patent
Pace

(10) Patent No.: US 10,132,074 B2
(45) Date of Patent: Nov. 20, 2018

(54) BRACKET AND PERGOLA SYSTEM

(71) Applicant: Grady Pace, Benton, LA (US)

(72) Inventor: Grady Pace, Benton, LA (US)

( * ) Notice: Subject to any disclaimer, the term of this patent is extended or adjusted under 35 U.S.C. 154(b) by 0 days.

(21) Appl. No.: 15/791,407

(22) Filed: Oct. 23, 2017

(65) Prior Publication Data

US 2018/0112391 A1 Apr. 26, 2018

Related U.S. Application Data

(60) Provisional application No. 62/411,110, filed on Oct. 21, 2016.

(51) Int. Cl.

| | |
|---|---|
| ***E04B 1/38*** | (2006.01) |
| ***E04C 5/00*** | (2006.01) |
| ***E04B 1/26*** | (2006.01) |
| ***E04F 10/08*** | (2006.01) |
| ***E04B 1/00*** | (2006.01) |
| *E04B 7/04* | (2006.01) |

(52) U.S. Cl.

CPC ..... *E04B 1/2612* (2013.01); *E04B 1/0046* (2013.01); *E04B 1/2608* (2013.01); *E04F 10/08* (2013.01); *E04B 7/045* (2013.01); *E04B 2001/2616* (2013.01); *E04B 2001/405* (2013.01)

(58) Field of Classification Search

CPC .. E04B 1/2612; E04B 2001/405; E04B 7/163; E04B 1/2608; E04F 10/08; E04D 3/3608

USPC ..... 52/289

See application file for complete search history.

(56) References Cited

U.S. PATENT DOCUMENTS

| | | | | |
|---|---|---|---|---|
| 2,628,796 | A * | 2/1953 | Krizman | H01Q 1/1221 248/237 |
| 3,533,587 | A * | 10/1970 | Vecchiarelli et al. | E04F 10/08 248/228.5 |
| 4,826,122 | A * | 5/1989 | Cupp | E04G 3/26 182/111 |
| 5,603,187 | A * | 2/1997 | Merrin | E04D 13/12 248/237 |
| 5,788,204 | A * | 8/1998 | Goodwin | E04G 5/02 182/111 |
| 5,797,694 | A * | 8/1998 | Breivik | E04B 1/2608 403/231 |
| 5,799,680 | A * | 9/1998 | Dorflinger | E04G 5/12 135/116 |
| 5,975,471 | A * | 11/1999 | Dishman | E04B 7/02 182/45 |
| 7,753,327 | B2 * | 7/2010 | Wooten | A47B 96/061 248/248 |
| 8,225,575 | B2 * | 7/2012 | Gadd | E04B 1/2612 52/289 |
| 8,640,420 | B1 * | 2/2014 | Halley | E04F 10/08 52/650.1 |
| 9,139,999 | B2 * | 9/2015 | Nicholls | E04B 1/2612 |
| 9,428,902 | B1 * | 8/2016 | LoFranco | E04B 1/40 |
| 2002/0020137 | A1 * | 2/2002 | Commins | E04B 1/2604 52/712 |

(Continued)

*Primary Examiner* — Brian D Mattei

(74) *Attorney, Agent, or Firm* — Davis & Bujold PLLC

(57) ABSTRACT

The invention is related to methods and pergola systems comprising a plurality of pergola components, a plurality of pergola brackets that engage with the pergola components and allow for the pergola components to attach to a building at a range of angles with respect to the pergola bracket.

9 Claims, 10 Drawing Sheets

(56) References Cited

U.S. PATENT DOCUMENTS

| | | | | |
|---|---|---|---|---|
| 2006/0185311 | A1* | 8/2006 | Attalla | E04B 7/045 52/639 |
| 2007/0000200 | A1* | 1/2007 | Fairbairn | E04F 10/08 52/473 |
| 2008/0121273 | A1* | 5/2008 | Plaisted | F16L 3/127 136/251 |
| 2008/0250748 | A1* | 10/2008 | Lewis | E04B 1/2612 52/715 |

* cited by examiner

BRACKET AND PERGOLA SYSTEM

CROSS REFERENCE TO RELATED APPLICATIONS/PRIORITY

The present invention claims priority to United States Provisional Patent Application No. 62/411,110 filed Oct. 21, 2016, which is incorporated by reference into the present disclosure as if fully restated herein. Any conflict between the incorporated material and the specific teachings of this disclosure shall be resolved in favor of the latter. Likewise, any conflict between an art-understood definition of a word or phrase and a definition of the word or phrase as specifically taught in this disclosure shall be resolved in favor of the latter.

BACKGROUND OF THE INVENTION

Pergolas are a popular outdoor addition to a home, but have unresolved disadvantages. Pergolas normally allow rain to pass through and pergolas may have issues with strength and stability. Pergolas built with conventional technology that are attached to a separate structure like a home ("attached pergolas") require special notching and cutting angles that most people find challenging. Many attached pergolas according to conventional technology are also designed such that there is no ability to add "fall" for a properly functioning watertight pergola. Attempts to address these issues have been unsuccessful in the past. For the foregoing reasons, there is a pressing, but seemingly irresolvable need for a watertight and stable pergola system.

SUMMARY OF THE INVENTION

Wherefore, the present invention is directed to methods and apparatuses that, among other things, satisfy the above shortcomings and drawbacks. The disclosed pergola bracket and pergola system facilitate the pergola construction by a home-owner who is not a carpentry professional and also can easily provide for a fall for the disclosed pergola to be properly watertight.

A first embodiment of the presently claimed invention is directed to pergola systems, kits, and methods of construction comprising a plurality of pergola components and a plurality of pergola brackets that engage with the pergola components and allow for the pergola components to attach to a building at a range of angles with respect to the pergola bracket, and a ledger, upon which the brackets attach. A second embodiment of the presently claimed invention is directed to pergola brackets comprising a base, a first side extending orthogonally from a first edge of the base, a second side extending orthogonally from a second edge of the base and defining a gap between the first side and the second side, a plurality of base through holes defined in the base to allow the base to be fastened to a ledger, a first side through hole defined in the first side, a second side through hole defined in the second side, the first side through hole aligned with the second side through hole to allow a bolt to pass through the first and the second side through holes and a pergola component engaged within the gap of the pergola bracket and thereby retain the pergola component.

The invention is related to methods and pergola systems comprising a plurality of pergola components, a plurality of pergola brackets that engage with the pergola components and allow for the pergola components to attach to a building at a range of angles with respect to the pergola bracket. According to a further embodiment, the plurality of pergola brackets engage with a common ledger. According to a further embodiment, the plurality of pergola brackets are fixedly attached to the common ledger. According to a further embodiment, the pergola components have a curved engaging end. According to a further embodiment, the pergola brackets have semicircular perimeter edges. According to a further embodiment, the pergola components have a curved engaging edge that substantially matches a curve of the semicircular perimeter edges. According to a further embodiment, a leading edge of the pergola components fits between two sides of the pergola bracket. According to a further embodiment, a component through hole in the pergola components aligns with a respective first and second bracket through hole such that a fastener may be inserted through the first bracket through hole, the component through hole, and the second bracket through hole to retain the pergola component engaged within the pergola bracket. According to a further embodiment, the fastener is a bolt and nut. According to a further embodiment, the plurality of pergola brackets are fixedly attached to the common ledger through fasteners fastened through one or more base through holes in each pergola bracket, but where one or more additional base through holes in each pergola bracket are free from fastener, allowing the common ledger to be attached to the building through fasteners fasted through the one or more additional base through holes.

The invention is further related to methods and pergola brackets comprising a base, a first side extending orthogonally from a first edge of the base, a second side extending orthogonally from a second edge of the base and defining a gap between the first side and the second side, a plurality of base through holes defined in the base to allow the base to be fastened to a ledger, a first side through hole defined in the first side, a second side through hole defined in the second side, with the first side through hole aligned with the second side through hole to allow a bolt to pass through the first and the second side through holes and a pergola component engaged within the gap of the pergola bracket and thereby retain the pergola component. According to a further embodiment, the first side and the second side have respective semicircular first and second curved perimeters. According to a further embodiment, the first and second through holes are closer to their respective first and second curved perimeters than to their respective first or second edge. According to a further embodiment, an inner surface of one of the first side, the second side, and both the first and the second sides is textured to aid in retention of a pergola component.

Another object is to provide a rounded wood joist with a curved steel taco shape to allow a strong connection that is able to attach at a broad range of angles, such as up to 180°, up to 270°, and up to 330° rotation.

Various objects, features, aspects, and advantages of the present invention will become more apparent from the following detailed description of preferred embodiments of the invention, along with the accompanying drawings in which like numerals represent like components. The present invention may address one or more of the problems and deficiencies of the current technology discussed above. However, it is contemplated that the invention may prove useful in addressing other problems and deficiencies in a number of technical areas. Therefore the claimed invention should not necessarily be construed as limited to addressing any of the particular problems or deficiencies discussed herein.

BRIEF DESCRIPTION OF THE DRAWINGS

The accompanying drawings, which are incorporated in and constitute a part of the specification, illustrate various embodiments of the invention and together with the general description of the invention given above and the detailed description of the drawings given below, serve to explain the principles of the invention. It is to be appreciated that the accompanying drawings are not necessarily to scale since the emphasis is instead placed on illustrating the principles of the invention. The invention will now be described, by way of example, with reference to the accompanying drawings in which.

DETAILED DESCRIPTION OF THE PREFERRED EMBODIMENTS

Figure 1:
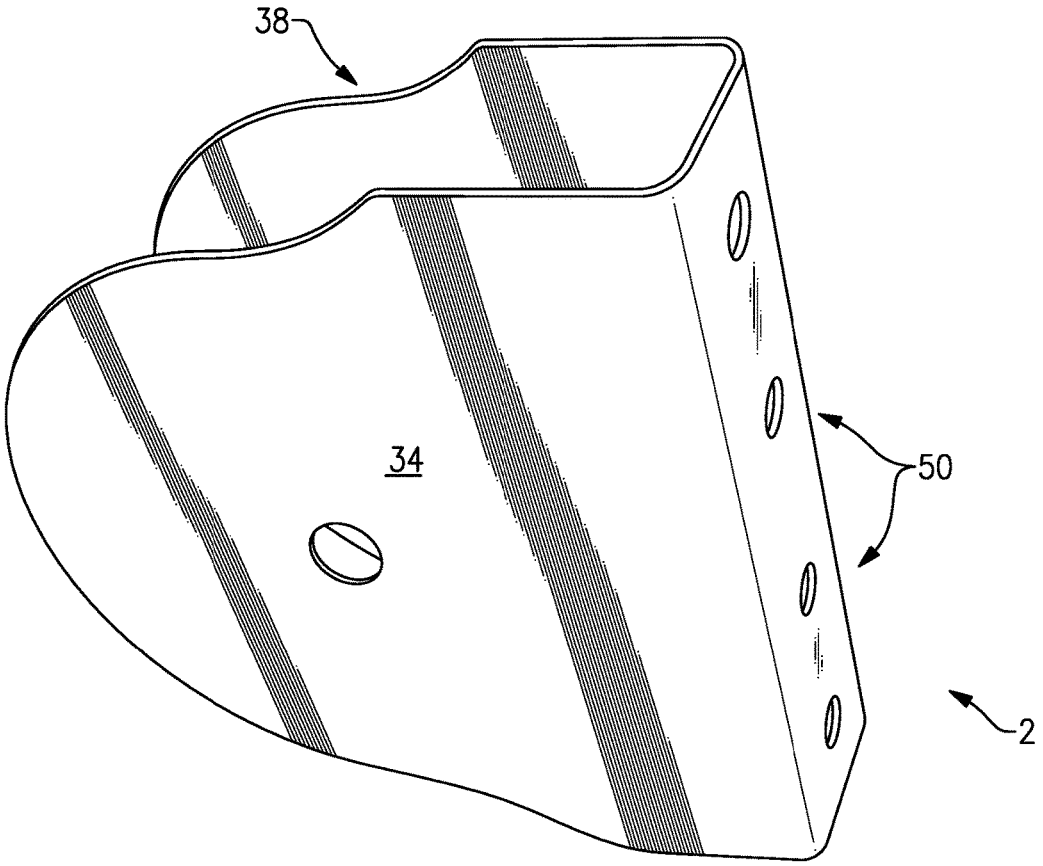
FIG. 1 is a photograph of an embodiment of a pergola bracket according the present invention, with the sides flattened coplanar with the base to show detail.

The present invention will be understood by reference to the following detailed description, which should be read in conjunction with the appended drawings. It is to be appreciated that the following detailed description of various embodiments is by way of example only and is not meant to limit, in any way, the scope of the present invention. In the summary above, in the following detailed description, in the claims below, and in the accompanying drawings, reference is made to particular features (including method steps) of the present invention. It is to be understood that the disclosure of the invention in this specification includes all possible combinations of such particular features, not just those explicitly described. For example, where a particular feature is disclosed in the context of a particular aspect or embodiment of the invention or a particular claim, that feature can also be used, to the extent possible, in combination with and/or in the context of other particular aspects and embodiments of the invention, and in the invention generally. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also one or more other components. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm, and whose upper limit is 100 mm. The embodiments set forth the below represent the necessary information to enable those skilled in the art to practice the invention and illustrate the best mode of practicing the invention. In addition, the invention does not require that all the advantageous features and all the advantages need to be incorporated into every embodiment of the invention.

Figure 2:
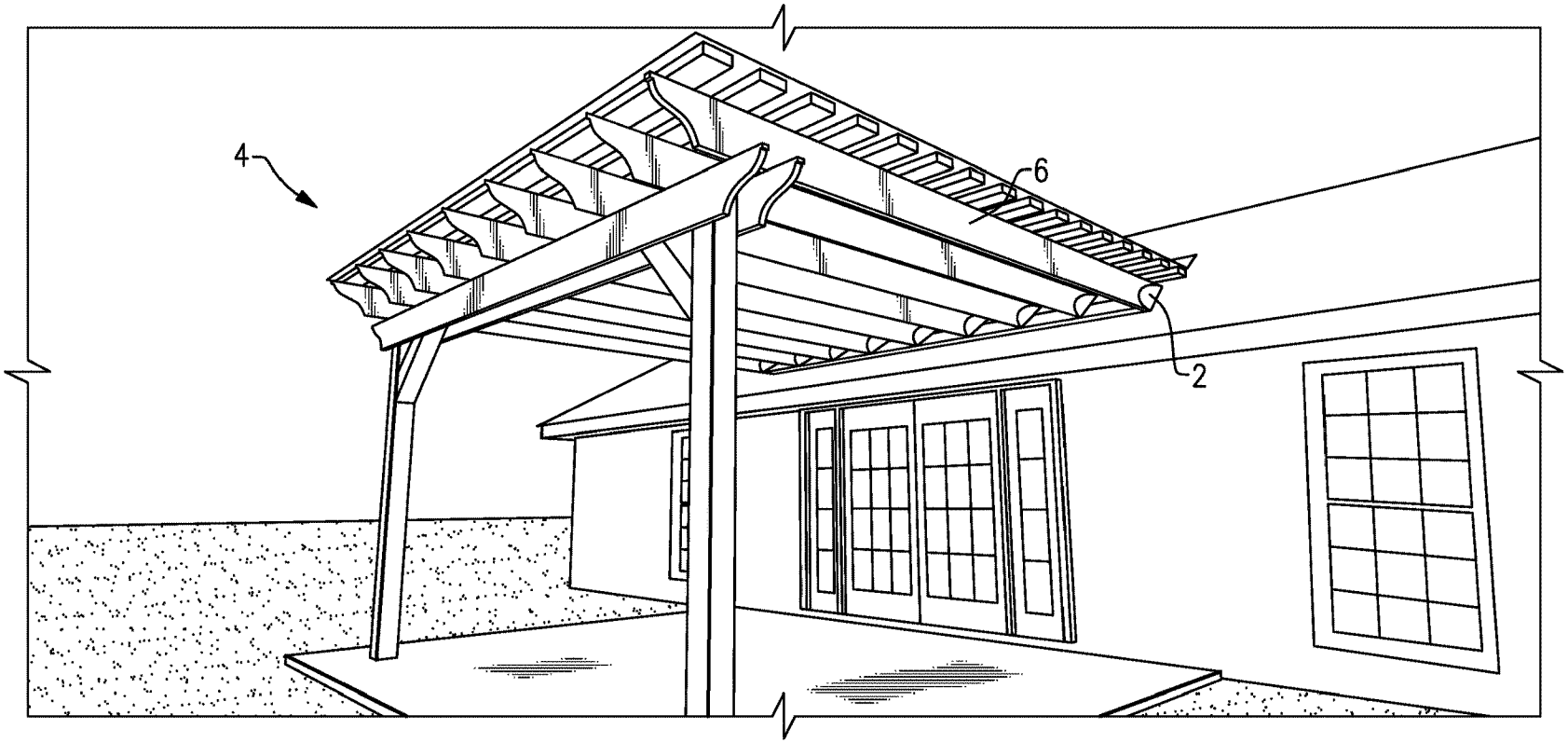
FIG. 2 is a side isometric view of an embodiment of a pergola system according to the present invention, using nine pergola brackets shown in FIG. 1, with a common ledger attached to the roof of a house.
Figure 3:
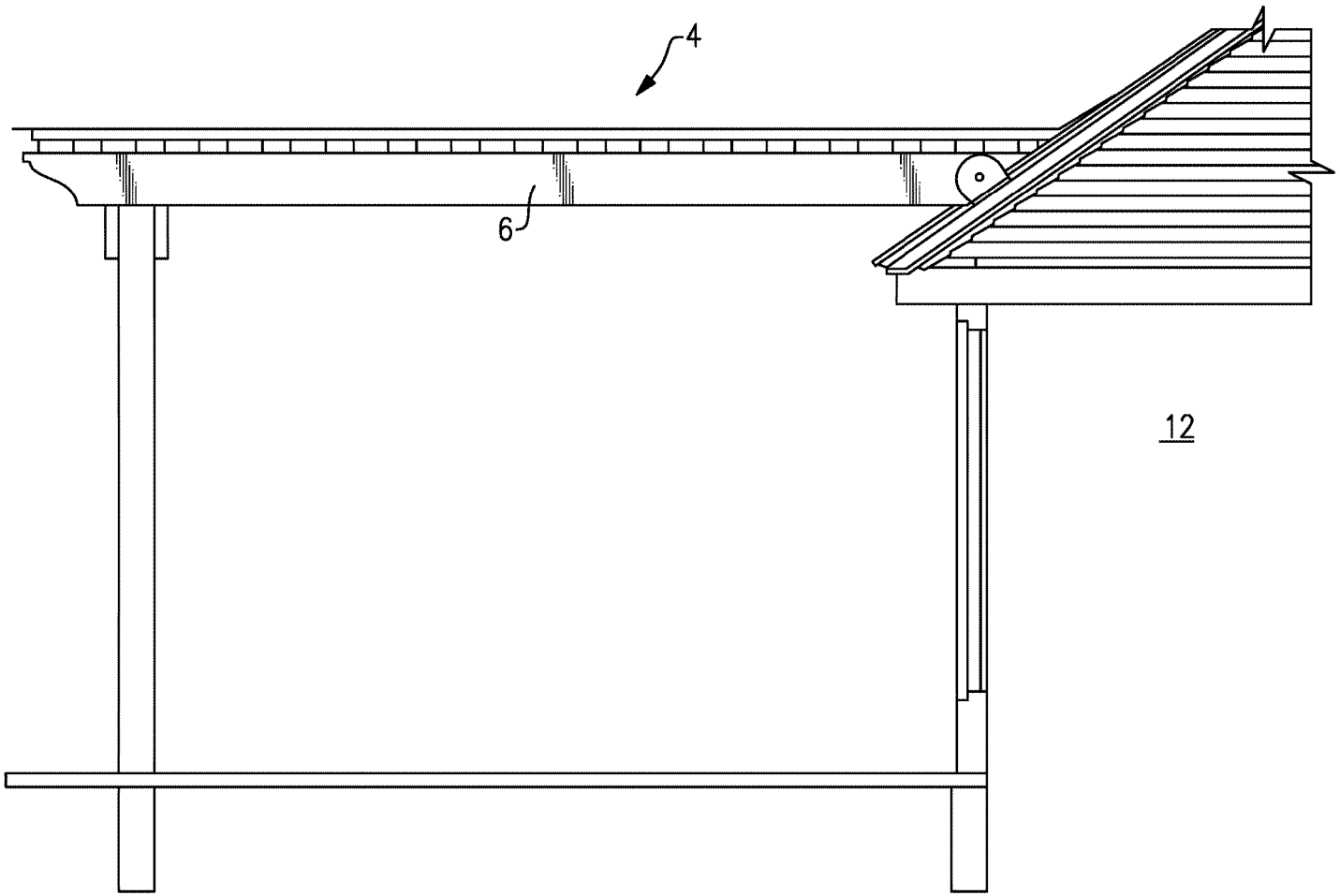
FIG. 3 is a side plan view of the pergola system of FIG. 2.
Figure 4:
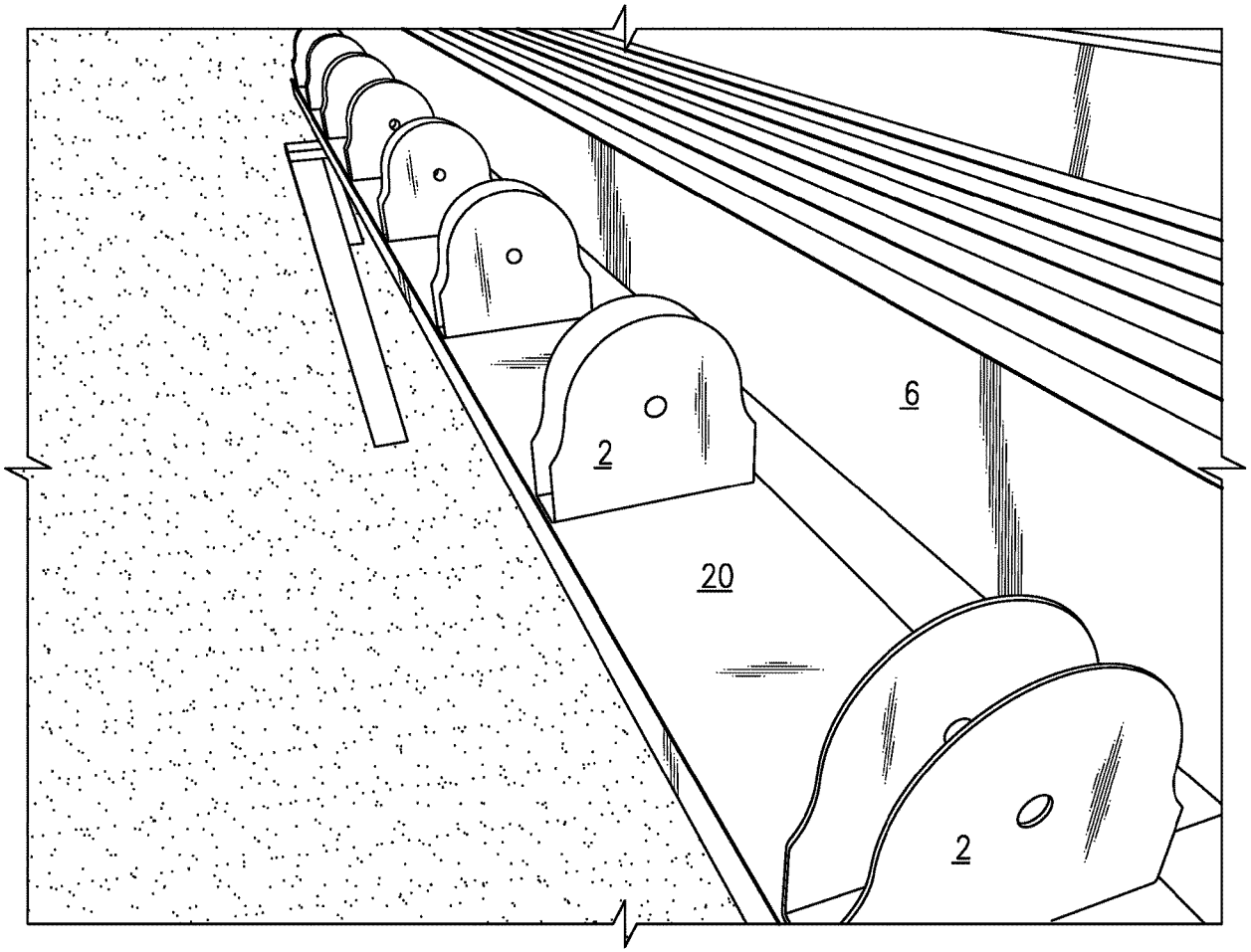
FIG. 4 is a photograph of eight pergola brackets shown in FIG. 1, each attached to a common ledger.
Figure 5:
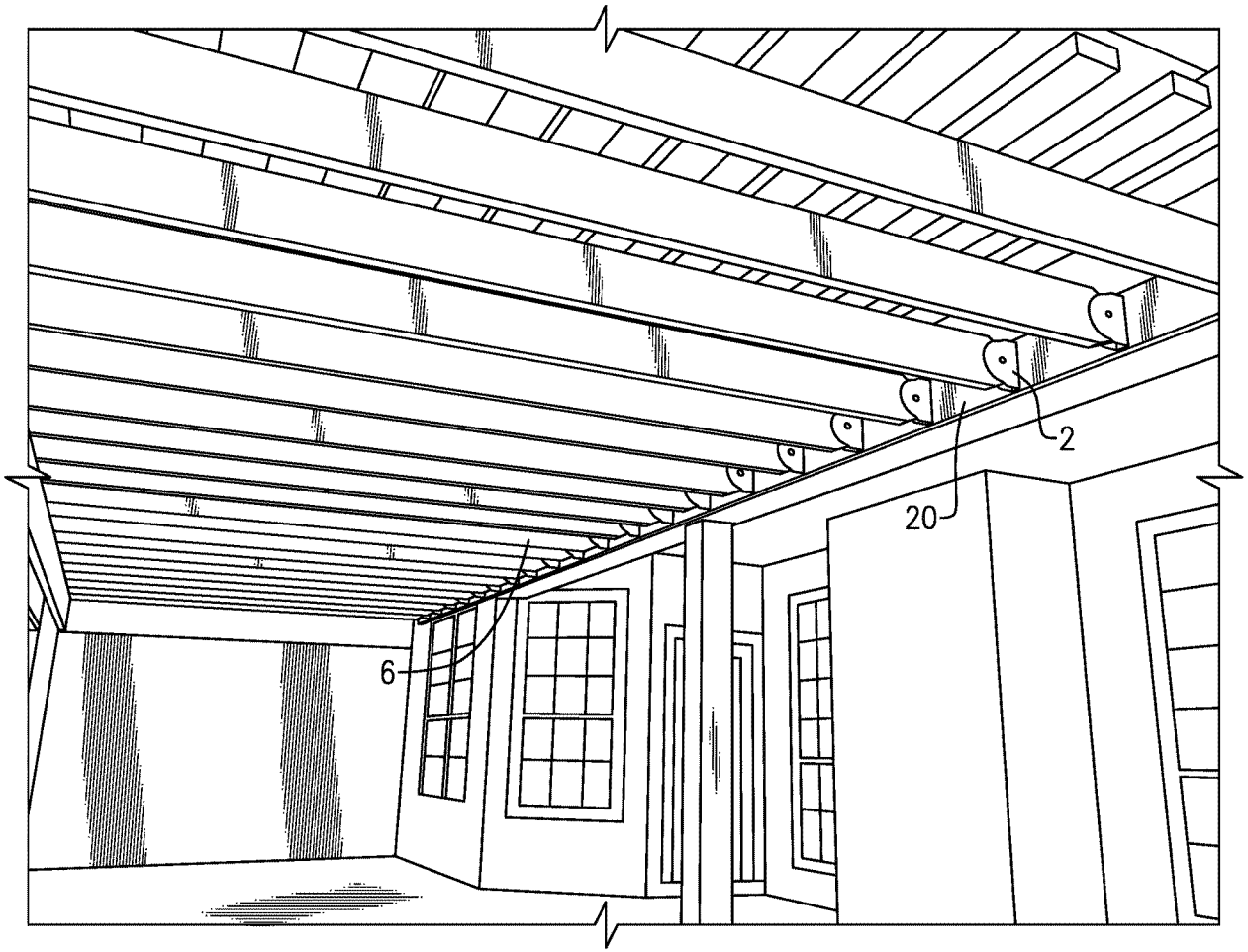
FIG. 5 is a photograph from below of second embodiment of the pergola system according to the present invention, using twenty one pergola brackets shown in FIG. 1, with the common ledger attached to fascia of the house.
Figure 6:
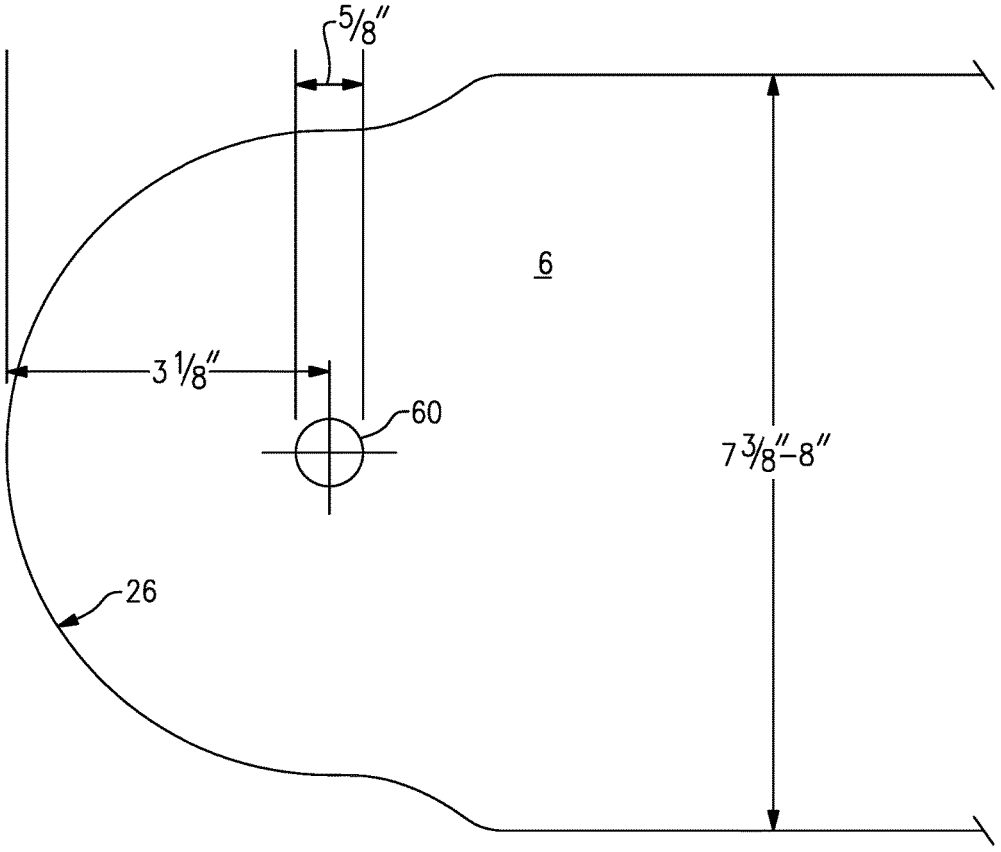
FIG. 6 is a side plan partial view of an engaging end of a pergola component according to the present invention.
Figure 7:
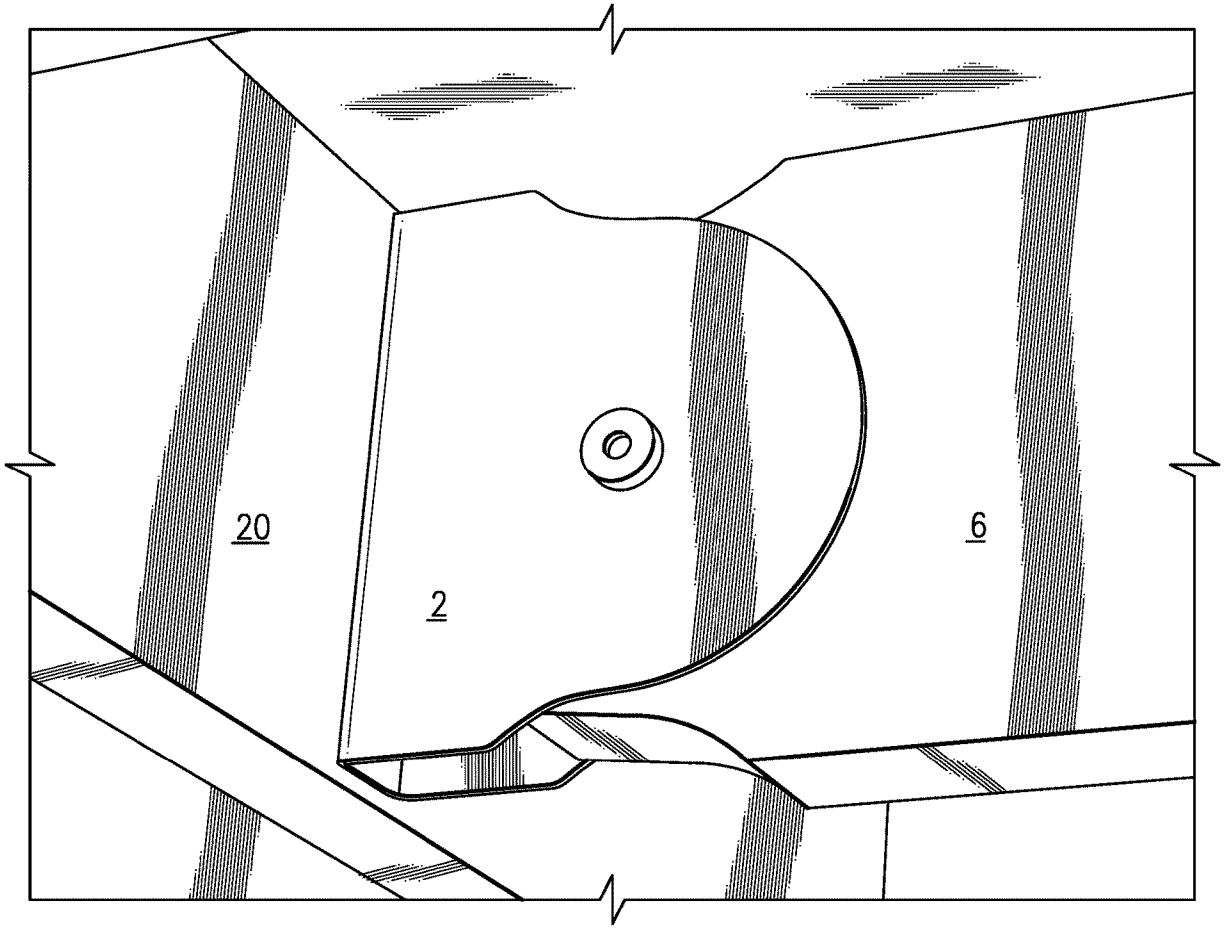
FIG. 7 is a photograph of a pergola component of FIG. 6 engaged with a pergola bracket of FIG. 1 that is attached to a ledger that is attached to a wall of a house.

Turning now to FIGS. 1-20, a brief description concerning the various components of the present invention will now be briefly discussed. As can be seen in this embodiment, the pergola bracket 2 and pergola system 4 is a novel way of attaching a pergola component 6, especially pergola joists 8 (the middle layer 10 in FIGS. 2 and 3) to any part of a house 12, such as the fascia 14, wall 16, or roof 18, preferably via a ledger 20, and allowing for the construction of a pergola 22. The disclosed pergola bracket 2 makes attaching a pergola 22 easy for a homeowner who is not professionally trained in carpentry. The pergola system 4 may be sold as a kit, preferably with the pergola brackets 2 pre-attached to the ledger 20.

The invention relates to pergola brackets 2 and pergola systems 4 and methods of construction and attachment including a pergola bracket 2, a pergola component 6, and a fastener 24.

Figure 10:
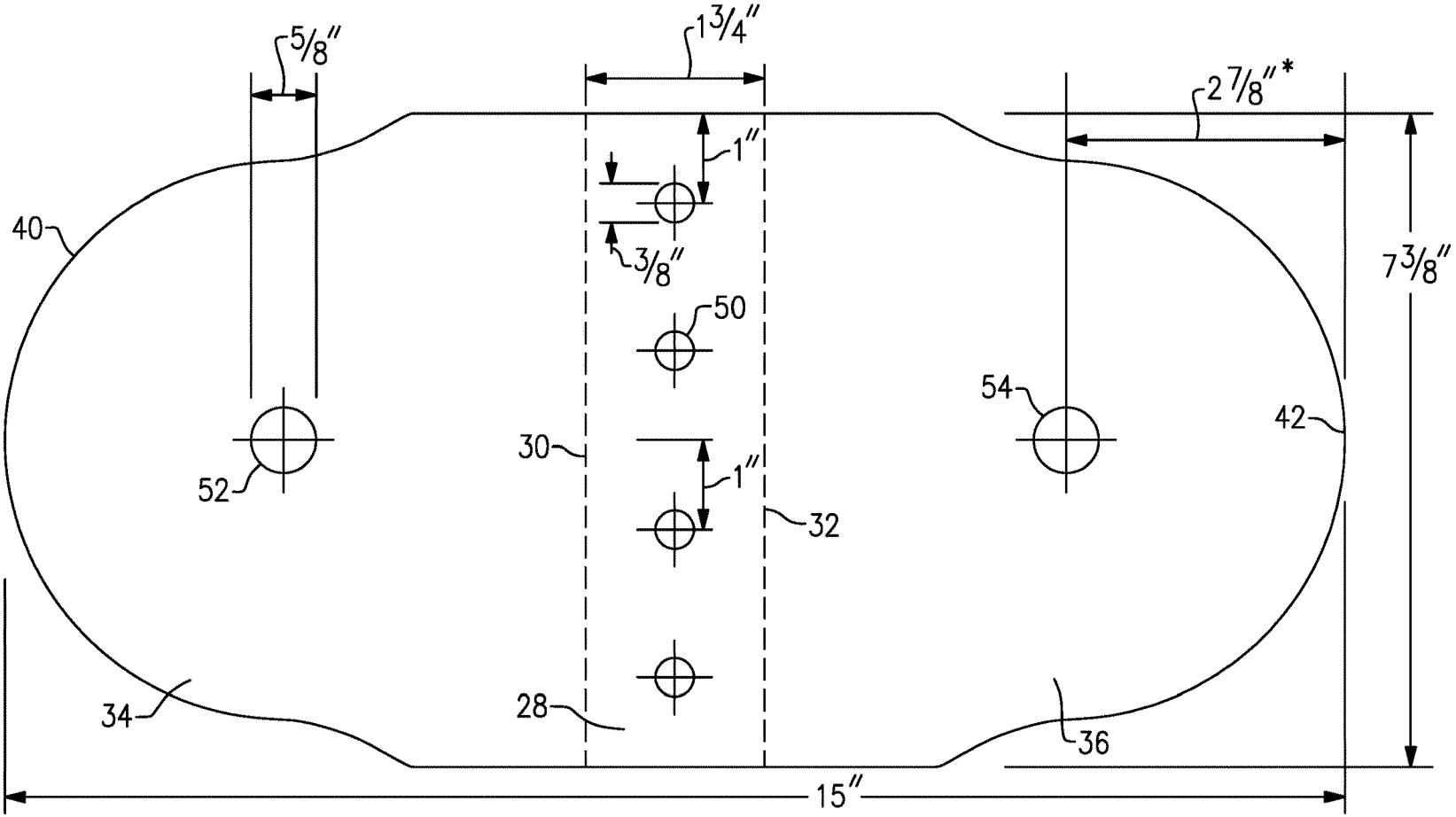
FIG. 10 is flat plan view of the pergola bracket of FIG. 1, with the sides flattened coplanar with the base to show detail.

Referring to FIGS. 1 and 10, the pergola bracket 2 will be discussed in further detail. The pergola bracket 2 provides a decorative, functional, strong, and flexible way to attach a preferably rounded engaging end 26 of a pergola component 6 (see FIG. 6) to a ledger and then preferably to a home or other structure (see FIGS. 7-9). The pergola bracket 2 is preferably 15 inch rolled steel with a rounded shape, though the thickness and shape may vary. The curve of the pergola bracket 2 and the preferably substantially matching curve of the engaging end 26 of the pergola component 6 allow for attachment of the pergola component 6 and pergola bracket 2 in a variety of locations on a house 12 in both a strong and astatically pleasing manner.

The pergola bracket 2 has a base 28 spacing apart and connecting a first side 30 and a second side 32. The first side 30 extends orthogonally from a first edge 34 of the base 28 and the second side 32 extends orthogonally from a second edge 36 of the base 28. The first side 30 and the second side 32 extend substantially parallel to one another and define a gap 38 between the first side and the second side, within which the pergola component 6 may engage the pergola bracket 2. The first and the second side preferably extend from the base at a same height for a defined distance, and then curve toward a semicircle shaped first and second curved perimeter 40, 42 on the respective first and the second sides.

An outer surface of the first and second sides is preferably smooth. An inner surface of the first and the second sides may be smooth, as shown, or may be textured, with ridges, bumps, or cleats, for example, to better grip the pergola component when it is engaged with the pergola bracket.

A plurality of base through holes 50 defined in the base to allow the base to be fastened to a ledger. Preferably two to six base holes are provided, more preferably three to five base holes are provided, most preferably four base holes are provided. The base holes are preferably centrally aligned, with each equidistance from the first and the second edge. In further embodiments, some or all of the base holes may be offset from the central alignment, and closer to one or the other of the first and second edge.

A first bracket through hole 52 is defined in the first side and a second bracket through hole 54 defined in the second side. The first and the second bracket through holes are preferably concentric with a center of the circles partially defined by the semicircle shaped first and second curved perimeters. The first and second bracket through holes are preferably closer to their respective curved perimeters than they are to their respective edges. In the embodiment shown, a preferable embodiment, the center of the through holes are 2⅞ inches from the respective curved perimeters, and 3¾ inches from the respective edges. In some embodiments the center of the through holes may be equidistant from the respective curved perimeter and the respective edges, but most preferably the centers of the through holes are not closer to the respective edges than they are to the respective curved perimeters.

The first bracket through hole is preferably equidistant from the first edge as the second bracket through hole is from the second edge, thereby aligning the first and the second bracket through holes to allow a bolt or other fastener to pass through the first and the second bracket through holes and a pergola component engaged within the gap and thereby retain the pergola component to the pergola bracket.

In a preferred embodiment, the pergola bracket is formed to accept a pergola component with a rounded engaging end, such as the embodiment shown in FIG. 10. In this embodiment, the pergola bracket is sized to fit a 2"×8" pergola component. The pergola bracket base measures approximately 1¾ inches wide and 7⅜ inches tall, with four ⅜ inch base holes. The sides are 6⅝ inches from the edge to the farthest curved perimeter from the edge. The bracket through holes are ⅝ inches. With the sides laid flat, as shown in FIG. 10, the pergola bracket is 15 inches wide. The steel is preferably approximately 0.26 gauge.

In other embodiments, the pergola bracket can be sized to fit pergola components such as 2"×4", 2"×6", 2"×10" and 2"×12" measurement. Additionally, the pergola brackets may be sized to engage 1×'s, 3×'s, and 4×'s, for example, in addition to 2×'s. The pergola bracket may also be designed to accept pergola components that do not have rounded engaging ends, by, for example, extending the length of the sides and the distance of the bracket through holes from the respective edges. This allows for stock, uncut/unrounded lumber to be used. This is less esthetic and requires larger pergola brackets, but offers benefits of efficiency in pergola component production.

The pergola bracket 2 may be scrolled or other decorative inlays could be applied during a laser cutout, for example, of the pergola bracket 2 to give it endless decorative options. The color of the pergola bracket 2 is preferably black, but could be changed to match the color of the pergola component or for another color. The pergola bracket could also be used to connect other projects to a house in a strong and decorative way with a great flexibility, including carports and awnings. The pergola bracket is preferably 0.26 gauge or thicker steel, but could be made from other metals, alloys, carbon fiber, and or plastics.

The pergola bracket may also have a flap (not shown) that attaches to a top of the pergola bracket and rests on or over a top edge of the pergola component, preferably matching the contours of top of the pergola bracket to prevent leaves or other debris from entering into the pergola bracket.

Though all of the pergola brackets are preferably attached to a single common ledger, multiple shorter ledgers with fewer pergola brackets on each may be used.

Turning to FIGS. 6-9, the pergola component is shown. The pergola component is preferably a joist preferably having a component through hole 60 with a rounded engaging end. Because the shape of the engaging end and the shape of the pergola bracket, and the location of the component through hole and the bracket through holes, the pergola component/pergola bracket connection is very strong over a continuous range of angles between the pergola component and the pergola bracket or preferably at least 180 degrees. The pergola component is preferably a 2×8 wooden joist. The component may be also be steel, vinyl, aluminum, other metals, alloys, carbon fiber, and or other plastics. The component may be 6, 8, 10, 12, or 20 feet long, for example, as needed for the specific pergola constructed.

Figure 8:
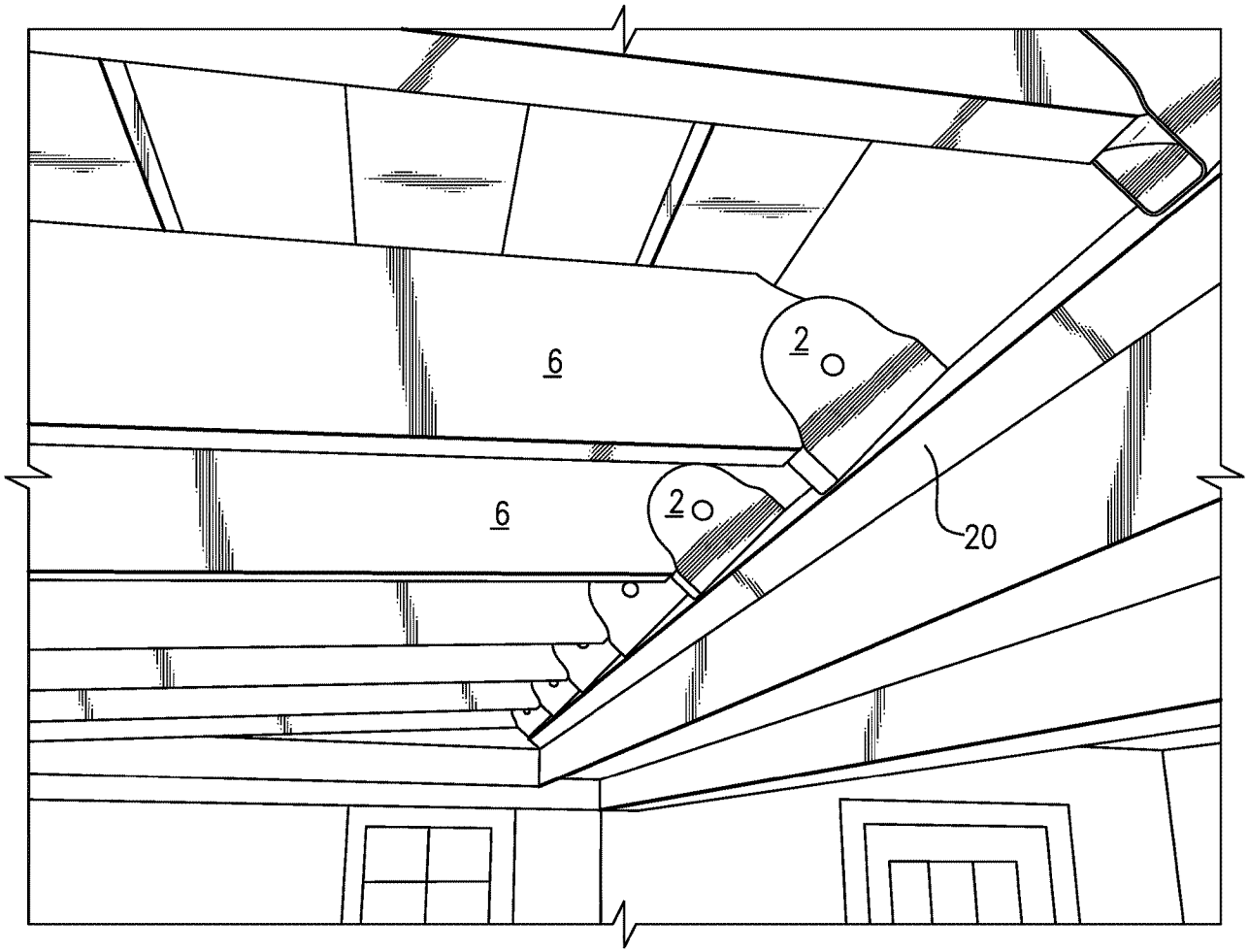
FIG. 8 is a photograph of a plurality of pergola components of FIG. 6, each engaged with a pergola bracket of FIG. 1 that are each attached to a common ledger that is attached to a roof of a house.
Figure 9:
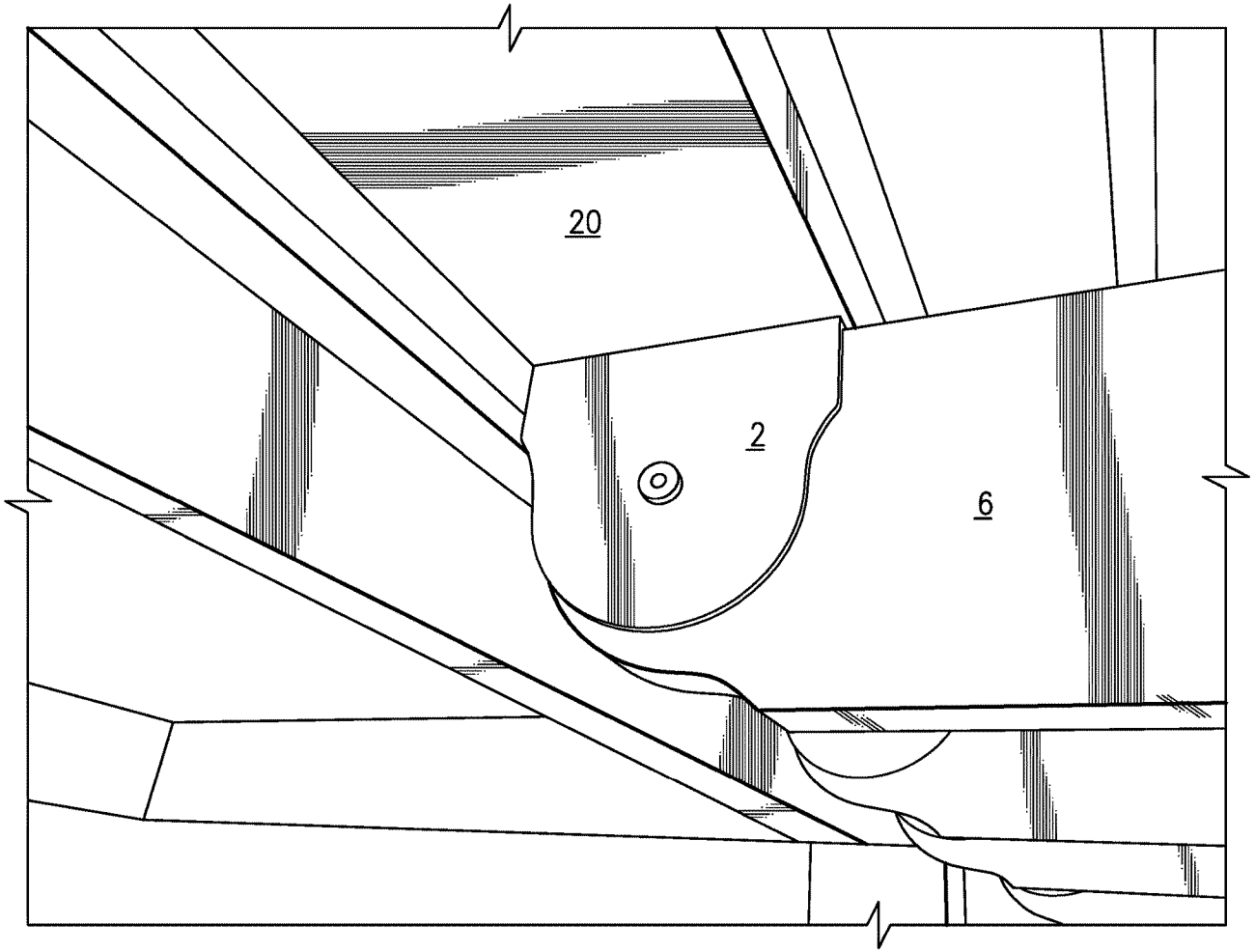
FIG. 9 is a photograph of a plurality of pergola components of FIG. 6, each engaged with a pergola bracket of FIG. 1 that are each attached to a common ledger that is attached to an under soffit of a house.

Turning to FIG. 8, the fastener is shown. The fastener is preferably a ½ inch by 2½ inch steel machine bolt and nut, though other bolts and fasteners, including preferably washers, could perform this function.

Exemplary Embodiment of Method to Construct a Pergola System:

1. Organize all Pergola Components and Ensure you have all pieces.
2. Layout for Posts D×W (Posts are Inset 17" on ALL SIDES)
3. Dig holes for posts set in Concrete, or Install concrete anchors for posts set on concrete.
4. Cut 6"×6" or 8"×8" Posts for 2"×12" Sandwich Beam (Bottom Layer in FIGS. 2 and 3) to a Proper Height. Preferably allow 3-5 inches of "Fall" away from house for Water Run Off, if installing a Watertight Pergola. If installing at a convex of two rooflines, such as in FIG. 6, the fall can be both the length and width direction, with each pergola component at slightly different and increasing angles toward to ground to create a fall from both rooflines.
5. Install 2×12 Sandwich Beam (Bottom Layer.)
6. Lay 6"×6" Posts Flat on Concrete or Deck parallel with each other.
7. Secure a 2×12" across each post at the top ensuring all is square.
8. Install Self-Starting 5" Lag Screws with a Drill and "Star" Bit into the 2×12"s
9. No need to Pre-Drill. All 5" Lags Screws are Self-Starting.

10. With 2 People, Stand Posts into holes or up onto concrete anchors. *Concrete to be added later. Level posts and add bracing if needed.

11. Attach common ledger with the attached plurality of pergola brackets onto Roof, Wall, Fascia, or Under Soffit using 5" Self-Starting Lag Screws. Preferably use a stud finder to find wall studs and framing, fascia rafter tails and roof rafters.

12. Cross-Measure from Corner of the Sunset Pergola Universal Bracket Ledger to the Opposite Corner of Sandwich Beam Tips (2×12's). Making sure the measurements are the same will ensure all pre-measured center marks will be square with house.

13. Once centered, continue placing 5" Self-Starting Lag Screws through the common ledger making sure to hit studs and/or rafters every 16", or wherever studs or rafters are present. Also, preferably place 5" Self-Starting Lag Screws through the un-used base holes in the pergola bracket.

14. Install Angle Bracing using 5" Self-Starting Lag Screws through the 2"×12" and into a 6"×6" post at an angle.

15. Secure second 2"×12" (Bottom Layer) with 5" Self-Starting Lag Screws. Three in each 6"×6" and two in all Angle Bracing.

16. Hang all Pre-Notched 2"×8" pergola components (Middle Layer in FIGS. 2 and 3.) *Find and hang the first and the last 2"×8". The First and Last 2"×8" will preferably have pre-marked "X"s on top for spacing the 2"×6" (Top Layer in FIGS. 2 and 3). All 2"×8" secure with a Black ½" Bolt and Nut on respective pergola brackets and get "toe-nailed" with 3" screws (PROVIDED) as they cover the "X" on top of each 2"×12" Sandwich Beam.

17. Install the 2"×6" (Top Layer.) To ensure proper spacing, place each 2"×6" over the "X" seen on the tops of the First and Last 2"×8". Secure each 2"×6" with two 3" Screws. Preferably, marks on each 2"×6" ensure the exact same overhang past the outside 2"×8".

18. Install 4' Polycarbonate Sheets making Pergola Watertight. Sheets should go up preferably perfectly square. Sheets are secured with ¾" screws with washers in EVERY OTHER VALLEY ON EVERY ODD 2"×6" . . . i.e. First, Third, Fifth. etc. *Tighten washer flat, but DO NOT BREAK RUBBER WASHER.) If washer is broken, simply use another screw.

19. Install 16" Flashing Under Existing Shingles or Siding Where Needed. Flashing to be tucked under one complete shingle and to be SCREWED DOWN TO POLYCARBONATE SHEETS ONLY WITH ¾" SCREWS ON EVERY OTHER RIB. It is preferable to not screw into shingles. *Caulk or other water proofer should preferably be used to cover each screw-head and to be placed between Sheets of Flashing if using more than one sheet. i.e. pergolas over 16' long, or for pergolas tucked in a corner requiring flashing on 2 or 3 sides.

20. Pergola is completed.

All or some portion of the items listed in the preceding paragraphs of the exemplary embodiment of method to contract the pergola system may be included in a kit.

The invention illustratively disclosed herein suitably may explicitly be practiced in the absence of any element which is not specifically disclosed herein. While various embodiments of the present invention have been described in detail, it is apparent that various modifications and alterations of those embodiments will occur to and be readily apparent those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items while only the terms "consisting of" and "consisting only of" are to be construed in the limitative sense.

Wherefore, I claim:

1. A pergola system comprising:

a plurality of pergola components with a curved engaging end; and a plurality of pergola brackets that engage with the pergola components and allow for the pergola components to attach to a building at a range of angles with respect to the pergola bracket;

wherein the pergola brackets include a base;

a first side extending orthogonally from a first edge of the base;

a second side extending orthogonally from a second edge of the base and defining a gap between the first side and the second side;

a first bracket through hole positioned centrally in the first side;

a second bracket through hole positioned centrally in the second side; and a plurality of base through holes defined in the base and positioned between the first edge and the second edge.

2. The pergola system of claim 1 further comprising a common ledger to which the plurality of pergola brackets engage.

3. The pergola system of claim 2 wherein the plurality of pergola brackets are fixedly attached to the common ledger.

4. The pergola system of claim 1 wherein the first and the second sides of the pergola brackets have semicircular perimeter edges.

5. The pergola system of claim 4 wherein the pergola components curved engaging edge substantially matches a curve of the semicircular perimeter edges.

6. The pergola system of claim 1 wherein a leading edge of the pergola components fits between the first and the second sides of the pergola bracket.

7. The pergola system of claim 1 wherein a component through hole in the pergola components aligns with the respective first and second bracket through hole such that a fastener may be inserted through the first bracket through hole, the component through hole, and the second bracket through hole to retain the pergola component engaged within the pergola bracket.

8. The pergola system of claim 7 wherein the fastener is a bolt and nut.

9. The pergola system of claim 2 wherein the plurality of pergola brackets are fixedly attached to the common ledger through fasteners fastened through first one or more of the base through holes, but where second one or more of the base through holes are free from fasteners, allowing the common ledger to be attached to a building through fasteners fasted through the second one or more of the base through holes.

* * * * *